US005395722A

United States Patent [19]

Nukada et al.

[11] Patent Number: 5,395,722

[45] Date of Patent: Mar. 7, 1995

[54] ELECTROPHOTOGRAPHIC PHOTORECEPTOR AND PRODUCTION PROCESS THEREOF

[75] Inventors: Katsumi Nukada; Motoko Komatsu, both of Minami Ashigara, Japan

[73] Assignee: Fuji Xerox Co., Ltd., Tokyo, Japan

[21] Appl. No.: 36,372

[22] Filed: Mar. 24, 1993

[30] Foreign Application Priority Data

Apr. 2, 1992 [JP] Japan ..... 4-108429

[51] Int. Cl.[6] ..... G03G 15/02

[52] U.S. Cl. ..... 430/59; 430/78; 430/127; 430/135

[58] Field of Search ..... 430/59, 78, 127, 135

[56] References Cited

U.S. PATENT DOCUMENTS

| | | | |
|---|---|---|---|
| 3,992,205 | 11/1976 | Wiedemann et al. | 96/16 |
| 4,419,427 | 12/1983 | Graser et al. | 430/58 |
| 4,587,189 | 5/1986 | Hor et al. | 430/59 |
| 5,019,473 | 5/1991 | Nguyen et al. | 430/58 |
| 5,223,364 | 6/1993 | Maeda et al. | 430/74 |

FOREIGN PATENT DOCUMENTS

| | | |
|---|---|---|
| 57-176047 | 10/1982 | Japan . |
| 59-59686 | 4/1984 | Japan . |
| 63-180956 | 7/1988 | Japan . |
| 63-243946 | 10/1988 | Japan . |
| 63-243947 | 10/1988 | Japan . |
| 63-291061 | 11/1988 | Japan . |
| 2-37356 | 2/1990 | Japan . |
| 2-228670 | 9/1990 | Japan . |
| 2-228671 | 9/1990 | Japan . |
| 3-24059 | 2/1991 | Japan . |

*Primary Examiner*—Mark A. Chapman
*Attorney, Agent, or Firm*—Oliff & Berridge

[57] ABSTRACT

An electrophotographic photoreceptor is disclosed, which comprises an electrically conductive substrate having formed thereon at least a charge generating layer and a charge transporting layer, wherein said charge generating layer is formed using a dispersed coating liquid prepared by mechanically grinding a perylene pigment and dispersing the ground perylene pigment in water, an alcohol series solvent, or an acetic acid ester solvent. A process of producing the photoreceptor is also disclosed. The electrophotographic photoreceptor provides a long pot life and stabilized dispersibility and electric characteristics.

15 Claims, 6 Drawing Sheets

ELECTROPHOTOGRAPHIC PHOTORECEPTOR AND PRODUCTION PROCESS THEREOF

FIELD OF THE INVENTION

The present invention relates to a high-sensitive electrophotographic photoreceptor prepared by using a coating liquid containing a perylene pigment excellent in the dispersion stability and to a production process thereof.

BACKGROUND OF THE INVENTION

Hitherto, as the charge generating material for an electrophotographic photoreceptor having a sensitivity to visible light and near infrared light, many materials such as condensed aromatic pigments, pyrylium dyes, perylene pigments, squarylium pigments, bisazo pigments, trisazo pigments, phthalocyanine pigments, etc., are known and various proposals have been made.

On the perylene pigments, various proposals have been made in JP-A-57-176047 (the term "JP-A" as used herein means an "unexamined published Japanese patent application"), JP-A-59-59686, JP-A-63-180956, JP-A-63-291061, JP-A-63-243947, JP-A-63-243946, JP-A-2-37356, JP-A-2-228670, JP-A-2-228671, JP-A-3-24059, and U.S. Pat. Nos. 4,587,189, 3,992,205, 4,419,427, 5,019,473, etc.

Also, as a method of forming a charge generating layer for an organic photosensitive material, a vapor deposition method and a coating method are generally known but the coating method is more advantageous for the production in the view points of not requiring a complicated evacuating apparatus, etc., and of easily controlling the film thickness.

A perylene pigment is an excellent charge generating material but there is a problem that when a charge generating layer composed of the perylene pigment is formed by a coating method, the sensitivity thereof becomes lower than the case of forming the charge generating layer of the perylene pigment by a vapor deposition method.

For improving this point, U.S. Pat. No. 5,019,473 described above proposes that a perylene pigment is mechanically ground and the finely powdered perylene pigment is used in a coating liquid for forming a charge generating layer. However, the coating liquid prepared by the method can form an electrophotographic photoreceptor initially showing an excellent sensitivity but since the electrophotographic photoreceptor is desensitized with the passage of time, the method is unsuitable for the case of forming the charge generating layer by a coating method.

SUMMARY OF THE INVENTION

The present invention has been made in view of the above-described circumstances in the conventional techniques and the object of the present invention is to provide a high-sensitive electrophotographic photoreceptor prepared using a pigment-dispersed coating liquid having a long pot life and having stabilized dispersibility and electric characteristics, and also to provide a production process thereof.

As the result of various investigations, the inventors have discovered that the desensitization of the electrophotographic photoreceptor having a charge .generating layer formed by using a coating liquid containing a perylene pigment has a close relation with the crystal growth or the crystal growth with a crystal dislocation of the perylene pigment with a solvent in the coating liquid. Also, as the result of investigating various solvents, the inventors have discovered that in the case of using cyclohexanone, tetrahydrofuran, toluene, etc., which are conventionally known as a solvent for the foregoing coating liquid, a perylene pigment easily causes the crystal growth but in the case of using water, an alcohol series solvent, or an acetic acid ester series solvent as the solvent for the foregoing coating liquid, a perylene pigment does not substantially cause the crystal dislocation and the crystal growth and hence a coating liquid of a perylene pigment having a long pot life and having stabilized dispersibility and electric characteristics is obtained, and have succeeded in accomplishing the present invention based on the discovery.

That is, according to an aspect of the present invention, there is provided an electrophotographic photoreceptor comprising an electrically conductive substrate having formed thereon at least a charge generating layer and a charge transporting layer, wherein the charge generating layer is formed using a dispersed coating liquid obtained by mechanically grinding a perylene pigment and dispersing the ground pigment in water, an alcohol series solvent, or an acetic acid ester series solvent.

Also, according to another aspect of the present invention, there is provided a process of producing an electrophotographic photoreceptor by forming on an electrically conductive substrate at least a charge generating layer and a charge transporting layer using a coating liquid for forming the charge generating layer and a coating liquid for forming the charge transporting layer, which comprises forming the charge generating layer using a dispersed coating liquid obtained by mechanically grinding a perylene pigment and dispersing the ground pigment in water, an alcohol series solvent, or an acetic acid ester series solvent.

DETAILED DESCRIPTION OF THE INVENTION

Then, each layer constituting the electrophotographic photoreceptor of the present invention is explained.

Figure 12:
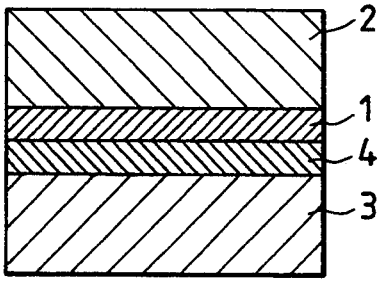
FIG. 12 is a schematic cross sectional view showing other example of the electrophotographic photoreceptor of the present invention.
Figure 13:
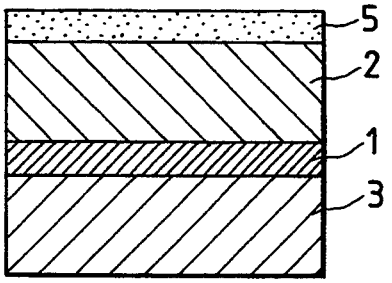
FIG. 13 is a schematic cross sectional view showing still other example of the electrophotographic photoreceptor of the present invention.
Figure 14:
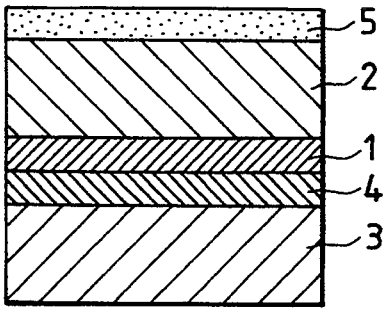
FIG. 14 is a schematic cross sectional view showing an another example of the electrophotographic photoreceptor of the present invention.

FIG. 11 to FIG. 14 are schematic cross sectional views showing several examples of the electrophotographic photoreceptor of the present invention. FIG. 11 to FIG. 14 each shows the case that the photosensitive layer is a laminated layer structure and in each example, a charge generating layer 1 is formed on an electrically conductive substrate 3 and a charge transporting layer 2 is formed on the charge generating layer 1. In FIG. 12, an undercoat layer 4 is further formed on the conductive substrate 3, in FIG. 13, a protective layer 5 is formed on the surface, and in FIG. 14, an undercoat layer 4 and a protective layer 5 are formed.

As an electrically conductive substrate, any substrates which can be usually used for electrophotographic photoreceptors can be used.

Specific examples of the substrate are metals such as aluminum, nickel, chromium, stainless steel, etc.; plastic films each coated with a thin layer of aluminum, titanium, nickel, chromium, stainless steel, gold, vanadium, tin oxide, indium oxide, ITO, etc.; and papers or plastic films each coated with or impregnated with an electrical conductivity-imparting agent.

The conductive substrate is used as a proper form such as a drum form, a sheet form, a plate form, etc., although the substrate form in the present invention is not limited to them.

Furthermore, if necessary, various kinds of surface treatments may be applied to the surface of the conductive substrate in the range of not giving influences on the images formed thereon. For example, an oxidation treatment, a chemical treatment, a coloring treatment, or a diffused reflection treatment such as sand grinding, etc., can be applied onto the surface.

In the present invention, an undercoat layer may be formed between the conductive substrate and the charge generating layer.

The undercoat layer has a function of preventing the injection of electrostatic charges from the conductive substrate into the photosensitive layers at charging the photosensitive layers and a function as an adhesive layer for keeping the photosensitive layers and the conductive substrate in a body by adhering them, or as the case may be, shows a function or preventing the reflection of light at the conductive substrate.

As a binder resin for the undercoat layer, a polyethylene resin, a polypropylene resin, an acrylic resin, a methacrylic resin, a polyamide resin, a vinyl chloride resin, a vinyl acetate resin, a phenol resin, a polycarbonate resin, a polyurethane resin, a polyimide resin, a vinylidene chloride resin, a polyvinyl acetal resin, a vinyl chloride-vinyl acetate copolymer, a polyvinyl alcohol resin, a water-soluble polyester resin, nitrocellulose, casein, gelatin, polyglutamic acid, starch, starch acetate, amino starch, a zirconium chelate compound, organic titanyl compounds (such as a titanyl chelate compound, titanyl alkoxide compound, etc.), a silane coupling agent, etc., can be used.

As a coating method employed at the formation of the undercoat layer, there are ordinary methods such as a blade coating method, a wire bar coating method, a spray coating method, a dip coating method, a bead coating method, an air knife coating method, a curtain coating method, etc.

The thickness of the undercoat layer is from 0.01 to 10 μm, and preferably from 0.05 to 2 μm.

The charge generating layer in the present invention is composed of the binder resin having dispersed therein a perylene series pigment and as the perylene series pigment, the pigments represented by the following general formulae (II), (III), and (IV) are used in this invention:

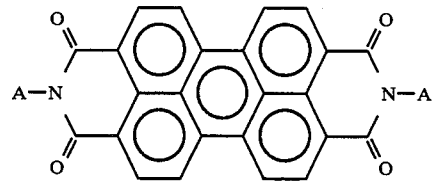

(II)

wherein A represents a hydrogen atom, an alkyl group having from 1 to 4 carbon atoms, a substituted or unsubstituted aryl group, an aralkyl group, an alkoxyalkyl group, a carboxylate group, a heterocyclic group, or an alkoxyaryl group;

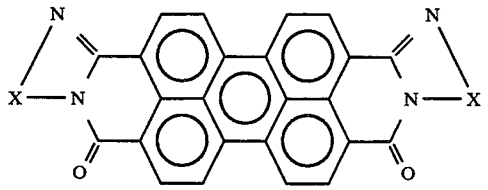

(III)

wherein X represents a divalent aromatic hydrocarbon group or a divalent heterocyclic group; and

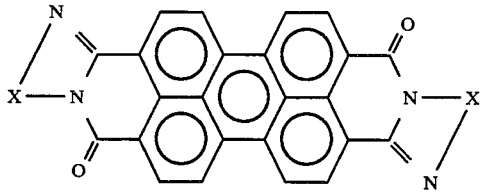

(IV)

wherein X has the same meaning as above.

Specific examples of the substituent groups for the substituted aryl group of A in general formula (II) include a phenyl group, a biphenyl group, a naphthyl group, a 4-methylphenyl group, a 2,4-dimethylphenyl group, a 3,5-dimethylphenyl group, a 4-chlorophenyl group, a 4-nitrophenyl group, a 4-methoxyphenyl group, etc.

Specific examples of the perylene series pigment being used preferably in the present invention are N,N'-diphenylperylene-3,4,9,10-tetracarboxylic acid diimide shown by the following formula (V), cis-bisbenzimidazo(2,1-a-1',1'-b)anthra(2,1,9-def:6,5,10-d'e'f')diisoquinoline-6,11-dione shown by the following formula (VI), and transbisbenzimidazo(2,1-a-1,1'-b)anthra(2,1,9-def:6,5,10-d'e'f')diisoquinoline-10,21-dione.

(V)

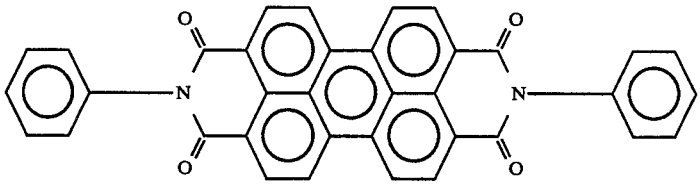

(VI)

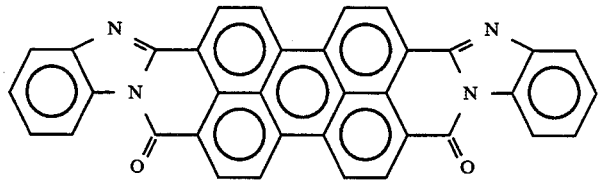

(VII)

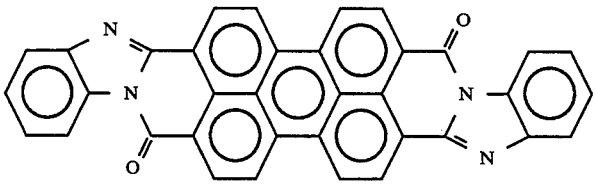

The perylene series pigment being particularly preferably used in the present invention is a bisbenzimidazole perylene pigment wherein the Bragg angle ($2\theta \pm 0.2°$) has the strong diffraction peaks at 6.2°, 12.3°, and 26.6° to 26.9° and the Bragg angle ($2\theta \pm 0.2°$) does not show the clear diffraction peak at 11.5° in the X-ray diffraction pattern thereof after mechanically grinding.

In addition, the foregoing perylene series pigment can be synthesized by a known method such as the methods described, e.g., in *Journal of Chemical Society,* 1764(1937) and JP-A-3-24059.

Also, it is preferred that before grinding the perylene series pigment, the perylene series pigment is purified by sublimation by the method described in foregoing JP-A-3-24059.

The perylene series pigment is mechanically ground after the synthesis or the purification by sublimation to provide the fine-powder pigment.

For mechanically grinding the perylene pigment, any known means such as a ball mill, a .mortar, a sand mill, a kneader, an attritor, a vibration mill, etc., can be used but a ball mill and a vibration mill are preferably used in this invention.

In the case of using a ball mill or a vibration mill, the diameter of the media for the mill is preferably from 1 mm to 30 mm and as the material of the media, iron, alumina, zirconia, stainless steel, etc., are used but ceramics such as alumina, zirconia, etc., are preferably used from the view point of obtaining a good image quality.

In the case of using a ball mill or a vibration mill, the amount of the media being used is from about 1 to 20 parts by weight to 1 part by weight of the pigment. If the amount of the media is too large, the occurrence of contamination is undesirably increased. In a practical case, the amount of the media is from about 5 to 10 parts by weight per 1 part by weight of the pigment.

The temperature for grinding is from 0° C. to 150° C., and preferably from room temperature to 100° C. Also, the grinding time is from 3 to 50 hours. If the grinding time is too long, the occurrence of contamination is increased and hence grinding is stopped when the particle size of the ground pigment becomes a proper size. In a practical case, the grinding time is from about 20 to 30 hours.

The particle sizes of the pigment after grinding are preferably from 0.03 μm (minor axis length)×0.05 μm (major axis length) to 0.05 μm×0.1 μm (the grain sizes of the unground pigment are from 10 μm×100 μm to 10 μm×500 μm).

The foregoing diameter and amount of the media, the grinding time, and the grinding time relate to each other and at practice, a proper condition is selected by observing the particle size of the pigment.

According to the apparatus being used for grinding the pigment, it sometimes happens that impurities originated from the apparatus intermix with the pigment and, in particular, when the pigment is ground using stainless steel, iron, etc., as the media, the impurities intermixed form conductive paths in the charge generating layer to cause defects for image quality and hence it is necessary to remove these mixed impurities from the pigment dispersed in a solvent by centrifugal separation utilizing the difference in specific gravities or by using a magnet, etc.

At mechanically grinding the perylene pigment, by using a grinding aid such as sodium chloride, borax, etc., crystals of the pigment having a uniform particle size can be obtained with a very good efficiency. The amount of the grinding aid may be in the range of from 5 to 200 parts by weight, and preferably from 10 to 30 parts by weight to 10 parts by weight of the pigment. If the amount of the grinding aid is too large, although the grinding efficiency is increased to some extent, after grinding, it is necessary to remove the grinding aid by washing and hence the excessive use of the grinding aid is undesirable for production.

The finely ground perylene pigment thus obtained is dispersed in water, an alcohol series solvent or an acetic acid ester series solvent having dissolved therein a proper binder resin to provide a dispersed coating liquid.

As the alcohol series solvent or the acetic acid ester series solvent, various kinds of solvents are used but from a problem of causing dripping the coating liquid and a problem of a drying temperature, the solvent having a boiling point of from 60° C. to 160° C. is properly used.

As the alcohol series solvent, for example, n-butanol, n-pentanol, n-hexanol, and sec-heptanol are suitably used and as the acetic acid ester series solvent, for example, ethyl acetate, propyl acetate, butyl acetate, and pentyl acetate are suitably used. Also, a mixed solvent of water and an alcohol may be used.

The binder resin can be properly selected from a wide range of insulating resins. Examples of the preferred binder resins are insulating resins such as a polyvinyl butyral resins, a polyarylate resin (a condensation product of bisphenol A and phthalic acid, etc.), a polycarbonate resin, a polyester resin, a polyacrylamide resin, a polyvinylpyridine resin, a cellulose resin, a urethane resin, an epoxy resin, casein, a polyvinyl alcohol resin, a polyvinyl pyrrolidone resin, etc. These insulating resins can be used singly or as a mixture thereof.

Also, the binder resin can be selected from organic photoconductive polymers such as poly-N-vinyl carbazole, polyvinyl anthracene, polyvinyl pyrene, polysilane, etc.

The dispersed coating liquid can further contain a surface active agent for the purpose of improving the dispersion stability.

The compounding ratio (weight ratio) of the perylene series pigment and the binder resin in the dispersion coating liquid is preferably in the range of from 10/1 to 1/10.

As a method of dispersing the perylene series pigment in the foregoing solvent, a ball mill dispersion method, an attritor dispersion method, a sand mill dispersion method, etc., can be employed.

Then, the dispersed coating liquid prepared as described above is formed on a conductive substrate to form a charge generating layer. The thickness of the charge generating layer in the present invention is generally from 0.1 to 5 μm, and preferably from 0.2 to 2.0 μm.

Also, for forming the charge generating layer, an ordinary coating method such as a blade coating method, a wire bar coating method, a spray coating method, a dip coating method, a bead coating method, an air knife coating method, a curtain coating method, etc., can be used.

On the charge generating layer formed as described above is, then, formed a charge transporting layer. In the present invention, the charge transporting layer can be formed using a coating liquid prepared by incorporating a charge transporting material in a solvent containing a proper binder resin.

As the charge transporting material, any known materials can be used. In particular, a benzidine series compound represented by the following general formula (I) can be preferably used in the present invention.

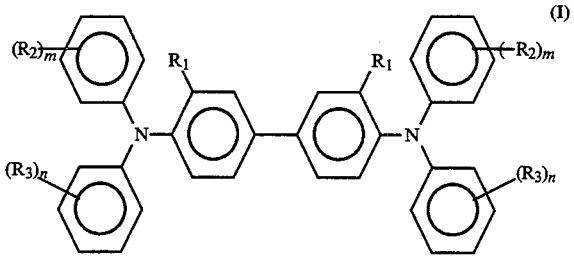

wherein $R_1$ represents a hydrogen atom, an alkyl group, an alkoxy group, or a halogen atom; $R_2$ and $R_3$ each represents a hydrogen atom, an alkyl group, an alkoxy group, a halogen atom, a substituted amino group; and m and n each represents 0, 1 or 2.

Specific examples of these benzidine series compounds are shown in Table 1, Table 2, and Table 3 shown below.

TABLE 1

| Compound No. | $R_1$ | $R_2$ | $R_3$ |
|---|---|---|---|
| I-1 | $CH_3$ | H | H |
| I-2 | $CH_3$ | 2-$CH_3$ | H |
| I-3 | $CH_3$ | 3-$CH_3$ | H |
| I-4 | $CH_3$ | 4-$CH_3$ | H |
| I-5 | $CH_3$ | 4-$CH_3$ | 2'-$CH_3$ |
| I-6 | $CH_3$ | 4-$CH_3$ | 3'-$CH_3$ |
| I-7 | $CH_3$ | 4-$CH_3$ | 4'-$CH_3$ |
| I-8 | $CH_3$ | 3,4-$CH_3$ | H |
| I-9 | $CH_3$ | 3,4-$CH_3$ | 3',4'-$CH_3$ |
| I-10 | $CH_3$ | 4-$C_2H_5$ | H |
| I-11 | $CH_3$ | 4-$C_3H_7$ | H |
| I-12 | $CH_3$ | 4-$C_4H_9$ | H |
| I-13 | $CH_3$ | 4-$C_2H_5$ | 2'-$CH_3$ |
| I-14 | $CH_3$ | 4-$C_2H_5$ | 3'-$CH_3$ |
| I-15 | $CH_3$ | 4-$C_2H_5$ | 4'-$CH_3$ |
| I-16 | $CH_3$ | 4-$C_2H_5$ | 3',4'-$CH_3$ |
| I-17 | $CH_3$ | 4-$C_3H_7$ | 3'-$CH_3$ |
| I-18 | $CH_3$ | 4-$C_3H_7$ | 4'-$CH_3$ |
| I-19 | $CH_3$ | 4-$C_4H_9$ | 3'-$CH_3$ |
| I-20 | $CH_3$ | 4-$C_4H_9$ | 4'-$CH_3$ |

TABLE 2

| Compound No. | $R_1$ | $R_2$ | $R_3$ |
|---|---|---|---|
| I-21 | $CH_3$ | 4-$C_2H_5$ | 4'-$C_2H_5$ |
| I-22 | $CH_3$ | 4-$C_2H_5$ | 4'-$OCH_3$ |
| I-23 | $CH_3$ | 4-$C_3H_7$ | 4'-$C_3H_7$ |
| I-24 | $CH_3$ | 4-$C_3H_7$ | 4'-$OCH_3$ |
| I-25 | $CH_3$ | 4-$C_4H_9$ | 4'-$C_4H_9$ |
| I-26 | $CH_3$ | 4-$C_4H_9$ | 4'-$OCH_3$ |
| I-27 | Cl | H | H |
| I-28 | Cl | 2-$CH_3$ | H |
| I-29 | Cl | 3-$CH_3$ | H |
| I-30 | Cl | 4-$CH_3$ | H |
| I-31 | Cl | 4-$CH_3$ | 2'-$CH_3$ |
| I-32 | Cl | 4-$CH_3$ | 3'-$CH_3$ |
| I-33 | Cl | 4-$CH_3$ | 4'-$CH_3$ |
| I-34 | $CH_3$ | 2-$N(CH_3)_2$ | H |
| I-35 | $CH_3$ | 3-$N(CH_3)_2$ | H |
| I-36 | $CH_3$ | 4-$N(CH_3)_2$ | H |
| I-37 | $C_2H_5$ | H | H |
| I-38 | $C_2H_5$ | 2-$CH_3$ | H |
| I-39 | $C_2H_5$ | 3-$CH_3$ | H |
| I-40 | $C_2H_5$ | 4-$CH_3$ | H |

TABLE 3

| Compound No. | $R_1$ | $R_2$ | $R_3$ |
|---|---|---|---|
| I-41 | $C_2H_5$ | 4-$CH_3$ | 4'-$CH_3$ |
| I-42 | $C_2H_5$ | 4-$C_2H_5$ | 4'-$CH_3$ |

TABLE 3-continued

| Compound No. | $R_1$ | $R_2$ | $R_3$ |
|---|---|---|---|
| I-43 | $C_2H_5$ | 4-$C_3H_7$ | 4'-$CH_3$ |
| I-44 | $C_2H_5$ | 4-$C_4H_9$ | 4'-$CH_3$ |
| I-45 | $OCH_3$ | H | H |
| I-46 | $OCH_3$ | 2-$CH_3$ | H |
| I-47 | $OCH_3$ | 3-$CH_3$ | H |
| I-48 | $OCH_3$ | 4-$CH_3$ | H |
| I-49 | $OCH_3$ | 4-$CH_3$ | 4'-$CH_3$ |
| I-50 | $OCH_3$ | 4-$C_2H_5$ | 4'-$CH_3$ |
| I-51 | $OCH_3$ | 4-$C_3H_7$ | 4'-$CH_3$ |
| I-52 | $OCH_3$ | 4-$C_4H_9$ | 4'-$CH_3$ |
| I-53 | H | 2-$CH_3$ | H |
| I-54 | H | 3-$CH_3$ | H |
| I-55 | H | 4-$CH_3$ | H |
| I-56 | H | 4-$CH_3$ | 4'-$CH_3$ |
| I-57 | H | 4-$CH_3$ | 4'-$C_2H_5$ |
| I-58 | H | 3-$CH_3$ | 3'-$CH_3$ |

These benzidine series compounds may be used singly or as a mixture thereof.

Furthermore, as the binder resin being used for the charge transporting layer in this invention, there are known resins such as a polycarbonate resin, a polyester resin, a methacrylic resin, an acrylic resin, a polyvinyl chloride resin, polyvinylidene chloride resin, polystyrene resin, polyvinyl acetate resin, a styrene-butadiene copolymer, a vinylidene chloride-acrylonitrile copolymer, a vinyl chloridevinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinyl carbazole, polysitane, etc., although the binder resin being used in the present invention is not limited to them. Also, these binder resins may be used singly or as a mixture thereof.

The compounding ratio (weight ratio) of the charge transporting material and the binder resin is preferably from 10/1 to 1/5.

In the present invention, the thickness of the charge transporting layer is generally from 5 to 50 μm, and preferably from 10 to 30 μm. As a coating method for forming the charge transporting layer, an ordinary method such as a blade coating method, a wire bar coating method, a spray coating method, a dip coating method, a bead coating method, an air knife coating method, a curtain coating method, etc., can be used.

Furthermore, as a solvent being used for forming the charge transporting layer, ordinary organic solvents, for example, aromatic hydrocarbons such as benzene, toluene, xylene, chlorobenzene, etc.; ketones such as acetone, 2-butanone, etc.; halogenated aliphatic hydrocarbons such as methylene chloride, chloroform, ethylene chloride, etc.; and cyclic or straight chain ethers such as tetrahydrofuran, ethyl ether, etc., can be used singly or as a mixture thereof.

In the electrophotographic photoreceptor of the present invention, the charge generating layer and the charge transporting layer can contain additives such as an antioxidant, a light stabilizer, a heat stabilizer, etc., for the purpose of preventing the occurrence of the deterioration of the photosensitive material by ozone and an oxidative gas generated in a copying machine or by light or heat.

Examples of the antioxidant are hindered phenols, hindered amines, paraphenylenediamine, arylalkane, hydroquinone, spirocoumarone, spiroindanone, the derivatives of them, organic sulfur compounds, and organic phosphorus compounds.

Examples of the light stabilizer are the derivatives such as benzophenone, benzotriazole, dithiocarbamate, tetramethylpiperidine, etc.

Also, the electrophotographic photoreceptor of the present invention can further contain at least one kind of an electron-acceptive material for the purposes of the improvement of the sensitivity, the reduction of the residual potential, the reduction of fatigue at the repeated use, etc.

Examples of the electron-acceptive material which can be used for the electrophotographic photoreceptor of the present invention are succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranyl, dinitroanthraquinone, trinitrofluorenone, picric acid, o-nitrobenzoic acid, p-nitrobenzoic acid, and phthalic acid. In these compounds, the benzene derivatives each having an electron acceptive substituent such as a fluorenone series substituent, a quinone series substituent, Cl, CN, $NO_2$, etc., are particularly preferred.

Furthermore, if necessary, a protective layer may be provided on the charge transporting layer. The protective layer is used for preventing the occurrence of the chemical change of the quality of the charge transporting layer at charging the photosensitive layer composed of the laminated layer structure and also for improving the mechanical strength of the photosensitive layer.

The protective layer is formed by containing an electrically conductive material in a suitable binder. Examples, but non-specific, of the electrically conductive material are metallocene compounds such as N,N'-dimethyl ferrocene, aromatic amine compounds such as N,N'-diphenyl-N,N'-bis(3-methylphenyl)-[1,1'-biphenyl]-4,4'-diamine, and metal oxides such as antimony oxide, tin oxide, titanium oxide, indium oxide, and tin oxide-antimony oxide.

As the binder resin being used for the protective layer, there are known resins such as a polyamide resin, a polyurethane resin, a polyester-resin, an epoxy resin, a polyketone resin, a polycarbonate resin, a polyvinyl ketone resin, a polystyrene resin, a polyacrylamide resin, etc.

Also, it is preferred that the protective layer is constituted such that the electric resistance thereof becomes from $1\times10^9$ to $1\times10^{14}$ Ω.cm. If the electric resistance of the protective layer is higher than $1\times10^{14}$ Ω.cm, the residual potential is increased to give duplicates having many fogs and if the electric resistance thereof is lower than $1\times10^9$ Ω.cm, images formed are blurred and the resolving power is lowered.

Furthermore, the protective layer must be constructed such that the layer does not substantially hinder the transmission of light being used for the image exposure.

The proper thickness of the protective layer being used in this invention is from 0.5 to 20 μm, and preferably from 1 to 10 μm.

Then, the present invention is explained by the following examples. In addition, in the following synthesis examples and the examples, "parts" are all "by weight".

Synthesis Example

Figure 1:
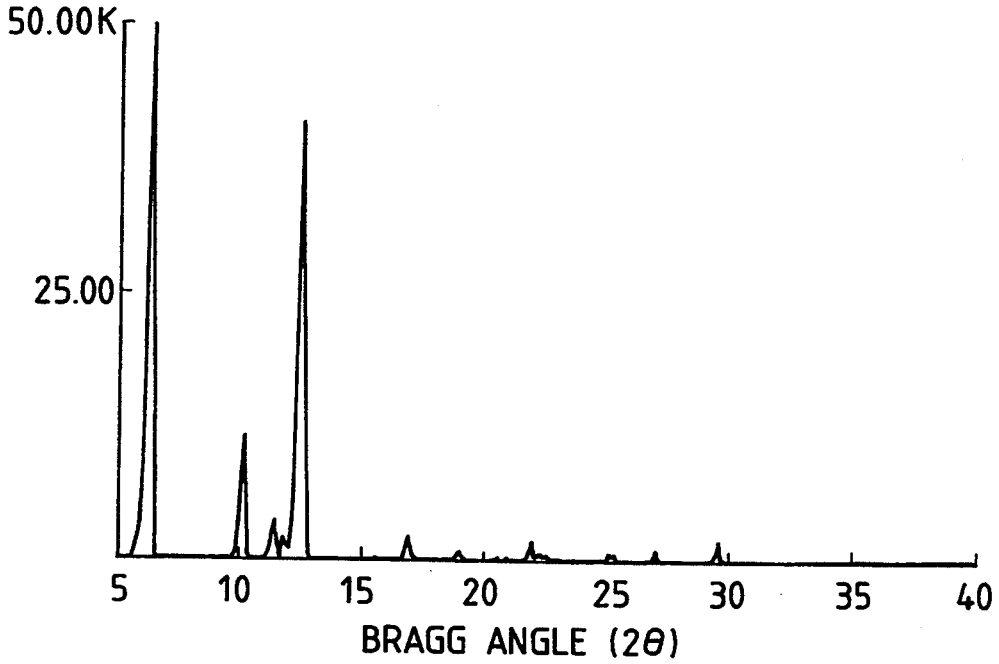
FIG. 1 is a graph showing the powder X-ray diffraction pattern of the bisbenzimidazole perylene pigment obtained in Synthesis Example 1.

In a 20 liter stainless steel reaction vessel were mixed 817 g (2.08 mols) of perylene-3,4,9,10-tetracarboxylic acid dianhydride, 1169 g (10.4 mols) of o-phenylenediamine, and 9.36 liters of 1-chloronaphthalene. The mixture obtained was heated to a temperature of from 240° C. to 250° C. for 3 hours with stirring and then cooled to room temperature. Then, a solid product formed was obtained by filtering the reaction mixture with a filter cloth and then washed thrice with N,N-dimethylformamide. Thereafter, the solid product was mixed with an alcohol solution of sodium hydroxide to provide a slurry. After filtering the slurry, the solid product collected was washed with N,N-dimethylformamide and then methanol, and then dried overnight in an oven at 95° C. to provide 1100 g of a bisbenzimidazole perylene pigment (a mixture of the cis form and the trans form). Furthermore, the pigment was purified by sublimation. The powder X-ray diffraction pattern of the pigment after the purification by sublimation is shown in FIG. 1 (showing strong peaks at 0.8°, 10.2°, and 12.5°).

The particle sizes of the pigment were from 10 μm×100 μm to 10 μm×500 μm.

Synthesis Example 2

Figure 2:
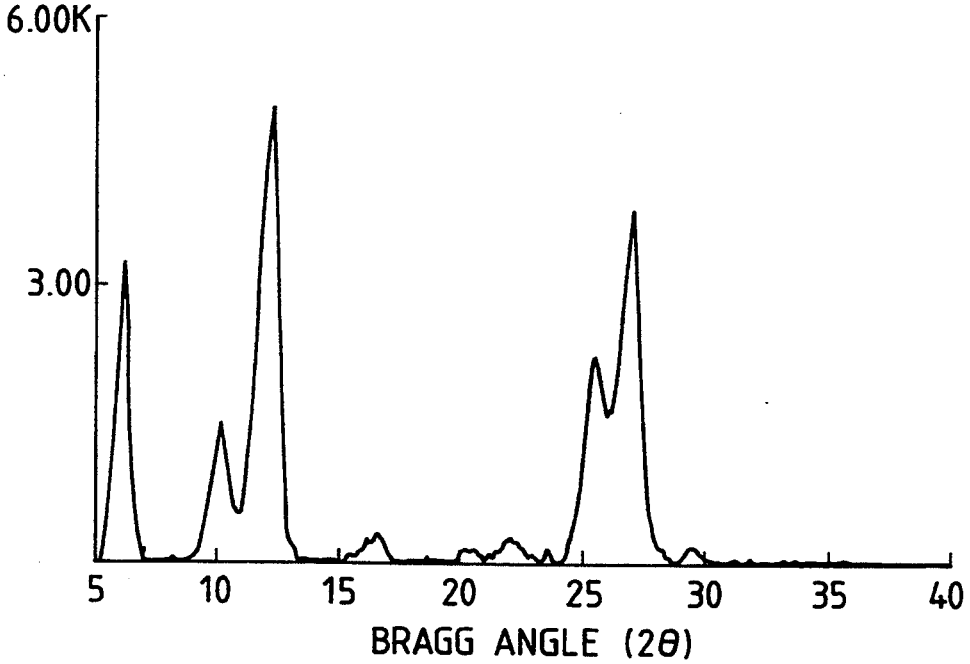
FIG. 2 is a graph showing the powder X-ray diffraction pattern of the bisbenzimidazole perylene pigment obtained in Synthesis Example 2.

Using a planetary ball mill type P-5 (manufactured by Fritsch Co.; agate pot inside diameter 100 mm and using 44 agate balls each having a diameter of 20 mm and 3 agate balls each having a diameter of 25 mm), 10 g of the bisbenzimidazole perylene pigment after the purification by sublimation obtained in Synthesis Example 1 was ground for 27 hours. The powder X-ray diffraction pattern of the finely powdered benzimidazole perylene pigment obtained is shown in FIG. 2 (showing strong peaks at 6.2°, 12.3°, and 27.0°).

The particle sizes of the pigment were from 0.04 μm×0.08 μm to 0.05 μm×0.1 μm.

Synthesis Example 3

Figure 5:
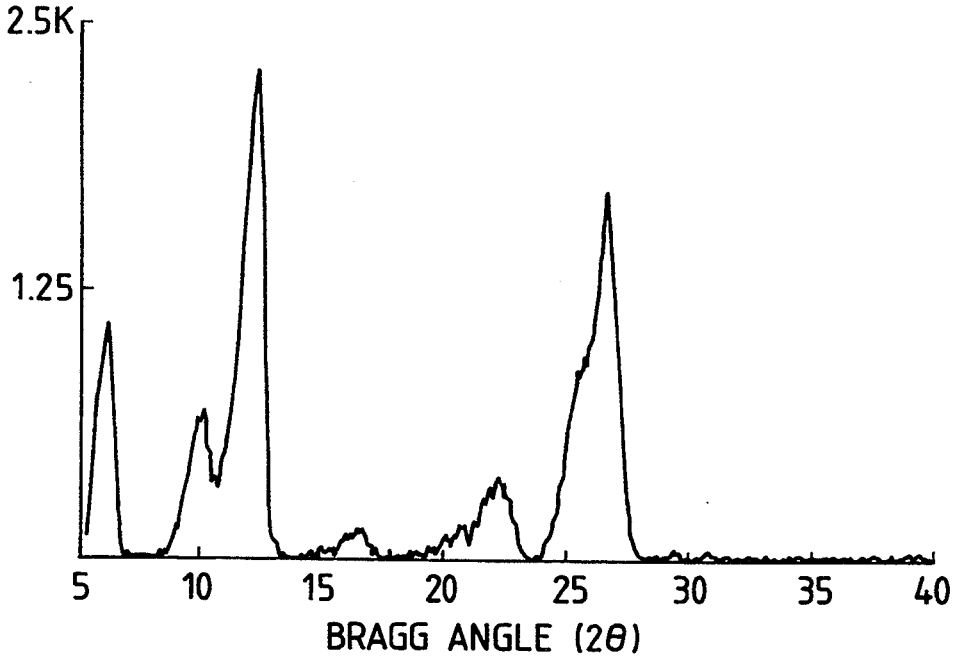
FIG. 5 is a graph showing the powder X-ray diffraction pattern of the bisbenzimidazole perylene pigment obtained in Synthesis Example 3.

After grinding 5 g of the benzimidazole perylene pigment after the purification by sublimation obtained in Synthesis Example 1 together with 10 g of sodium chloride using a planetary ball mill type P-5 (manufactured by Fritsch Co.; agate pot inside diameter 100 mm and using 44 agate balls each having a diameter of 20 mm and 3 agate balls each having a diameter of 25 mm) for 27 hours, the ground mixture was sufficiently washed with distilled water and dried to provide 4.8 g of the bisbenzimidazole perylene pigment. The powder X-ray diffraction pattern of the finely powdered bisbenzimidazole perylene pigment is shown in FIG. 5 (showing strong peaks at 6.2°, 12.2° C., and 26.6°).

The particle sizes of the pigment were from 0.03 μm×0.05 μm to 0.03 μm×0.1 μm.

Figure 3:
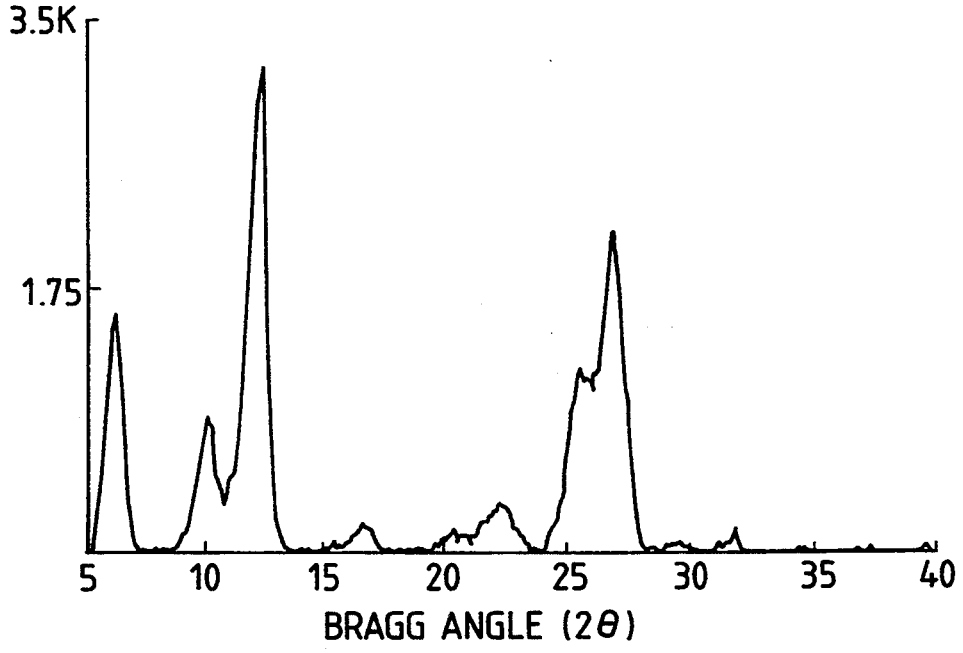
FIG. 3 is a graph showing the powder X-ray diffraction spectra of the fine-powdered bisbenzimidazole perylene pigment obtained in Stabilization Test 6 and the bisbenzimidazole perylene pigment after 2.5 hours since grinding in Synthesis Example 3.

Also, the powder X-ray diffraction pattern of the benzimidazole perylene pigment obtained by grinding by the same manner as above for 2.5 hours is shown in FIG. 3 (showing strong peaks at 6.3°, 12.3°, and 26.8°).

Figure 4:
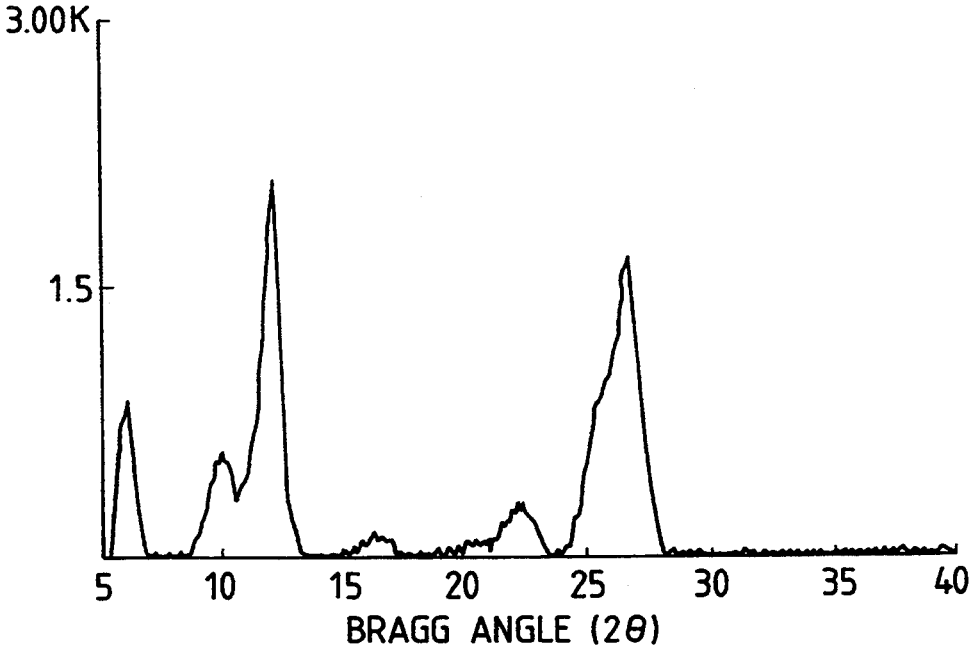
FIG. 4 is a graph showing the powder X-ray diffraction pattern of the bisbenzimidazole perylene pigment after 19 hours since grinding in Synthesis Example 3.

Furthermore, the powder X-ray diffraction pattern of the benzimidazole perylene pigment after 19 hours since grinding is shown in FIG. 4 (showing strong peaks at 6.1°12.1°, and 26.7°).

The peak of 26.9° shifted to the low angle side by grinding.

Synthesis Example 4

Figure 6:
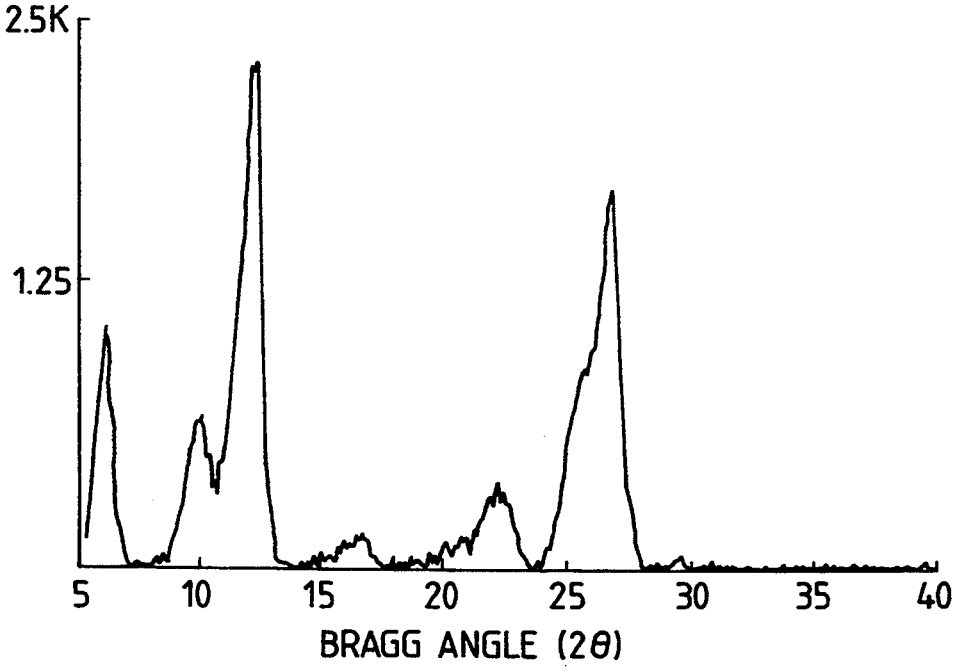
FIG. 6 is a graph showing the powder X-ray diffraction pattern of the bisbenzimidazole perylene pigment obtained in Synthesis Example 4.

After grinding 5 g of the bisbenzimidazole perylene pigment after the purification by sublimation obtained in Synthesis Example 1 together with 25 g of sodium chloride using. a planetary ball mill Type P-5 (manufactured by Fritsch Co.; agate pot inside diameter 100 mm, using 44 agate balls each having a diameter of 20 mm and 3 agate balls each having a diameter of 25 mm) for 27 hours, the ground pigment was sufficiently washed with distilled water and dried to provide 4.6 g of bisbenzimidazole perylene pigment. The powder X-ray diffraction pattern of the finely powdered bisbenzimidazole perylene pigment obtained is shown in FIG. 6 (showing strong peaks at 6.2°, 12.2°, and 26.6°).

The particle sizes of the pigment were from 0.03 μm×0.05 μm to 0.03 μm×0.1 μm.

[Stability Test in Solvent]

For determining the stability of the bisbenzimidazole perylene pigment after grinding in a solvent, 0.5 g of the finely powdered bisbenzimidazole perylene pigment obtained in Synthesis Example 3, 30 g of glass beads, and 15 ml of methylene chloride, monochlorobenzene, tetrahydrofuran, cyclohexane, dimethylformamide, water, butanol, ethylene glycol, or n-butyl acetate were placed in standard bottle No. 10 and after milling the mixture for 24 hours at 150 r.p.m., the pigment was washed with methanol and dried.

The powder X-ray diffraction pattern of each of the finely powdered benzimidazole perylene pigments thus obtained and the ultraviolet absorption spectrum of each pigment in a polyvinyl butyral resin film are shown in Table 4.

TABLE 4

Figure 7:
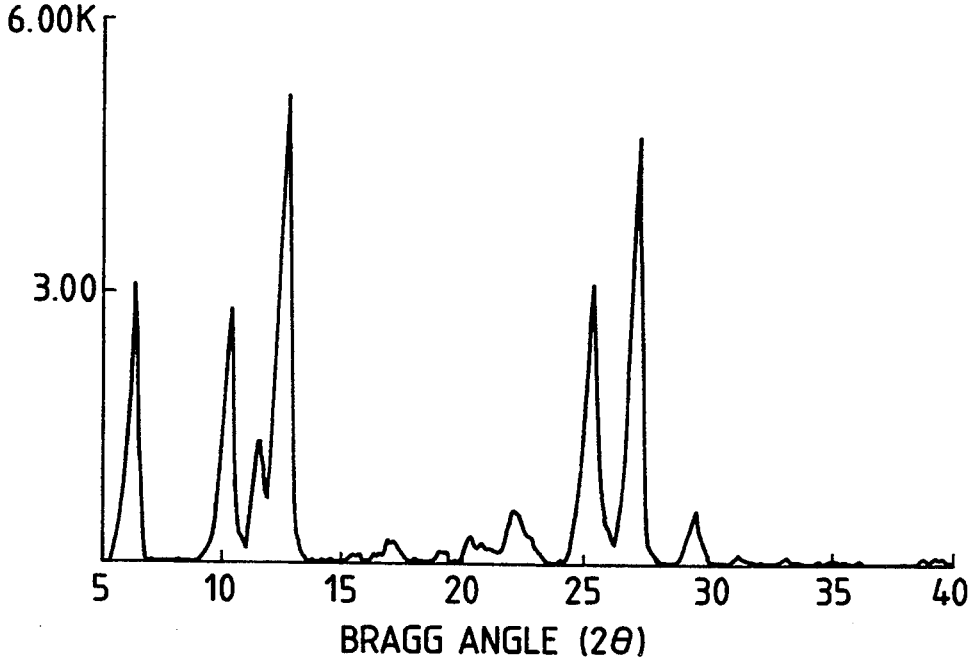
FIG. 7 is a graph showing the powder X-ray diffraction pattern of the fine-powdered bisbenzimidazole perylene pigment obtained in Stabilization Tests 1 to 5.
Figure 8:
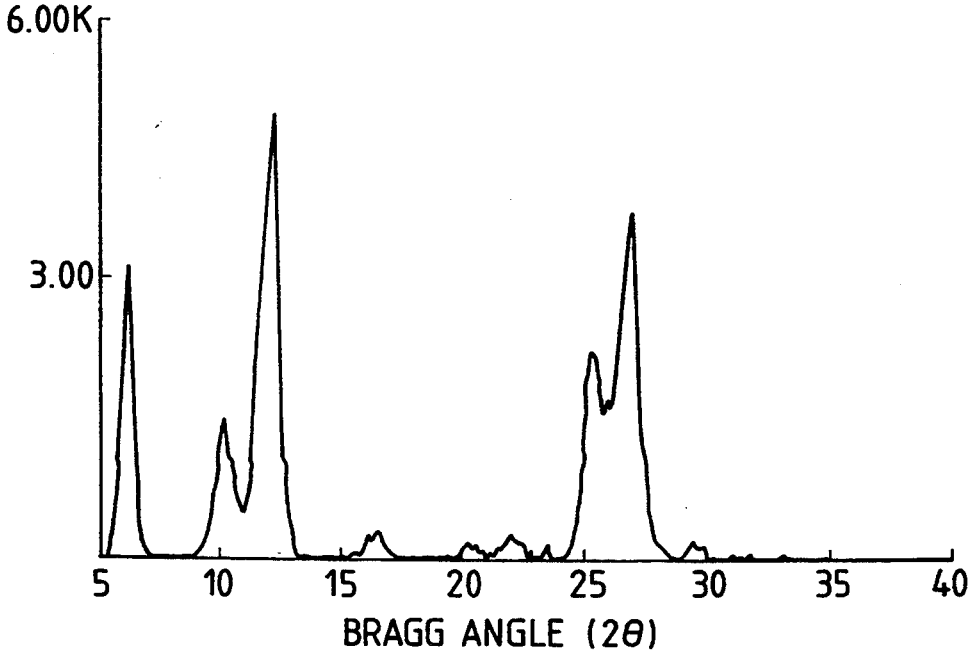
FIG. 8 is a graph showing the powder X-ray diffraction pattern of the fine-powdered bisbenzimidazole perylene pigment obtained in Stabilization Tests 7 to 9.
Figure 9:
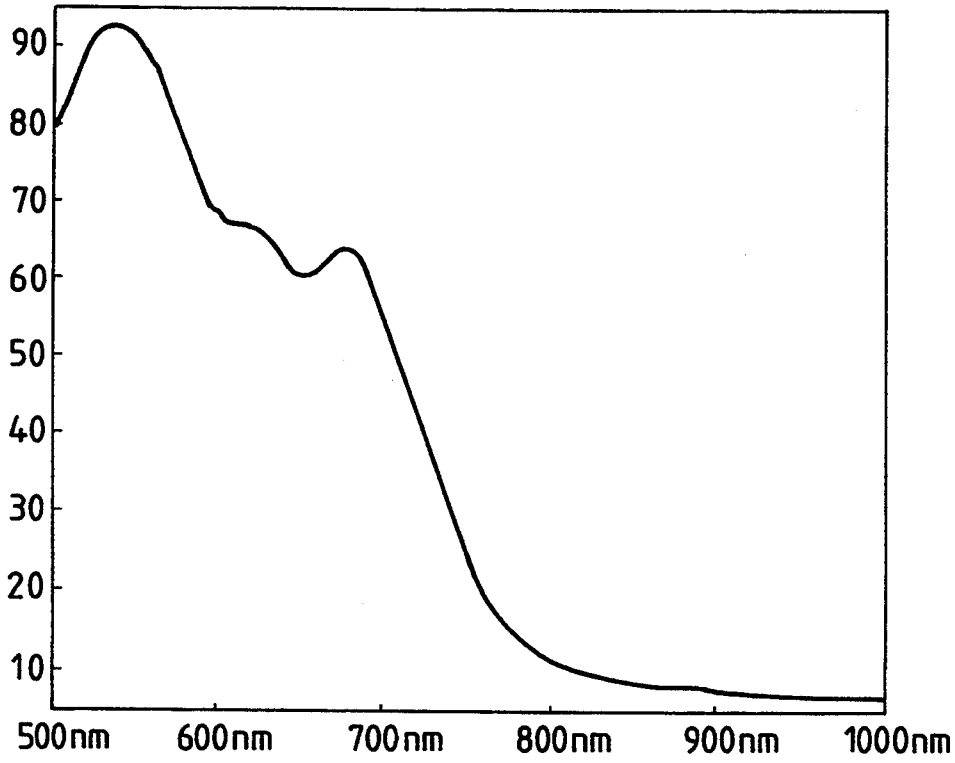
FIG. 9 is a graph showing the ultraviolet absorption spectrum of the fine-powdered bisbenzimidazole perylene pigment obtained in Stabilization Tests 1 to 5 in a polyvinyl butyral resin film.
Figure 10:
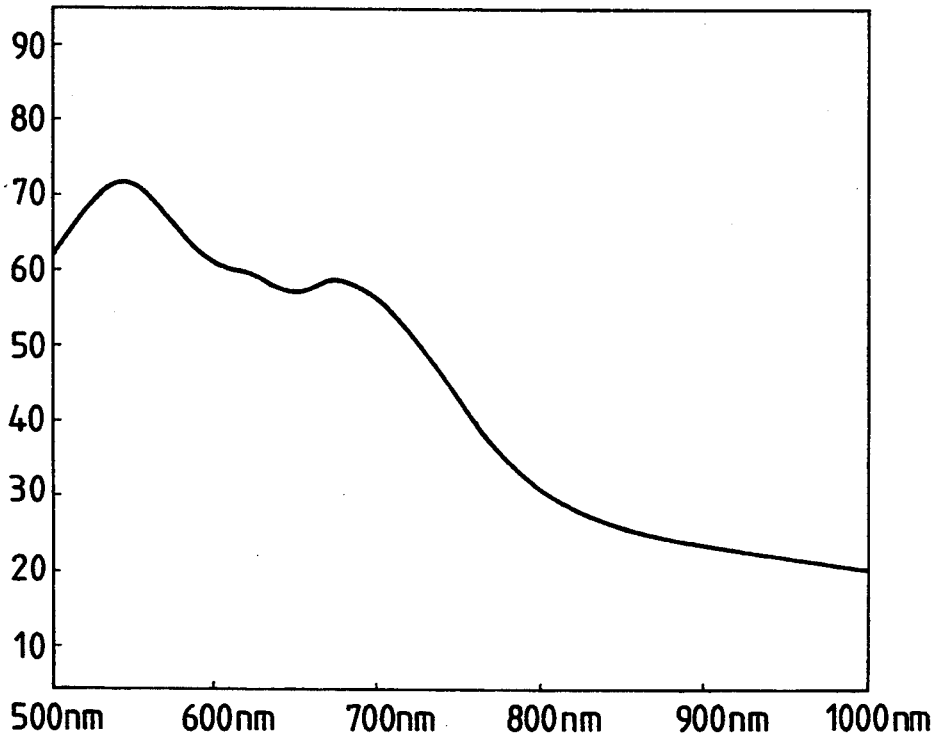
FIG. 10 is a graph showing the ultraviolet absorption spectrum of the fine-powdered bisbenzimidazole perylene pigment obtained in Stabilization Tests 6 to 9 in the polyvinyl butyral resin film.
Figure 11:
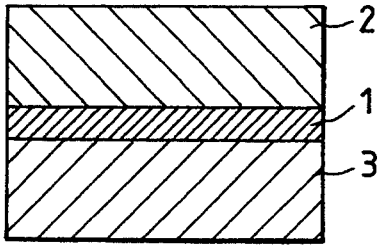
FIG. 11 is a schematic cross sectional view showing an example of the electrophotographic photoreceptor of the present invention.

| Stability Test | Solvent | Powder X-ray Diffraction Pattern | Ultraviolet Absorption Spectrum | Particle Size (μm) |
|---|---|---|---|---|
| Test 1 | Methylene Chloride | FIG. 7 | FIG. 9 | 0.1 × 0.2 – 0.15 × 0.2 |
| Test 2 | Monochcorobenzene | Same as FIG. 7 | Same as FIG. 9 | " |
| Test 3 | THF | Same as FIG. 7 | Same as FIG. 9 | " |
| Test 4 | Cyclohexanone | Same as FIG. 7 | Same as FIG. 9 | " |
| Test 5 | DMF | Same as FIG. 7 | Same as FIG. 9 | " |
| Test 6 | Water | Same as FIG. 3 | FIG. 10 | 0.03 × 0.05 – 0.03 × 0.1 |
| Test 7 | Butanol | FIG. 8 | Same as FIG. 10 | 0.04 × 0.05 – 0.04 × 0.1 |
| Test 8 | Ethylene Glycol | Same as FIG. 8 | Same as FIG. 10 | " |
| Test 9 | n-Butyl Acetate | Same as FIG. 8 | Same as FIG. 10 | " |

As is clear from the results of the powder X-ray diffraction patterns and the ultraviolet absorption spectra, it can be seen that the crystal growth occurs in methylene chloride, monochlorobenzene, tetrahydrofuran, cyclohexane, and dimethylformamide and the ultraviolet absorption shifted to a short wavelength side.

EXAMPLE 1

A coating liquid composed of 10 parts of an organozirconium compound (Orgatics ZC540, trade name, made by Matsumoto Seiyaku K. K.), 2 parts of a silane coupling agent (A1110, trade name, made by Nippon Unicar Co., Ltd.), 30 parts of isopropyl alcohol, and 30 parts of n-butanol was coated on an aluminum-plated plate by a dip coating method and dried by heating to 150° C. for 5 minutes to form an undercoat layer having a thickness of 0.1 μm.

Then, a coating liquid was prepared by mixing 0.1 part of the finely powdered bisbenzimidazole perylene pigment obtained in Synthesis Example 2 with 0.1 part of polyvinyl butyral (S-Lec BM-S, trade name, made by Sekisui Chemical Co., Ltd.), and 10 parts of butanol and dispersing the pigment therein by treating the mixture together with glass beads by means of a paint shaker for one hour and the coating liquid directly after dispersion or the coating liquid which was allowed to stand for one week for comparing the stability of the dispersion was coated on the undercoat layer by a dip coating method followed by drying at 100° C. for 5 minutes to form a charge generating layer having a thickness of 0.2 μm. Then, 1 part of a compound shown by the following structural formula (VIII) and 1 part of poly(4,4-cyclohexylidenediphenylene diphenylene carbonate) constituted by a repeating unit shown by the following structural formula (IX) were dissolved in 8 parts of monochlorobenzene and the coated liquid thus obtained was coated on the charge generating layer formed on the aluminum base plate by a dip coating method and dried by heating to 120° C. for one hour to form a charge transporting layer having a thickness of 20 μm.

(VIII)

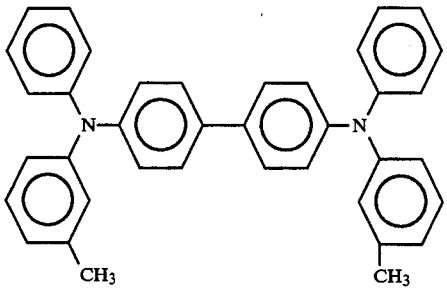

-continued (IX)

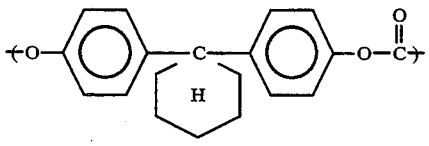

On the electrophotographic photoreceptor obtained, the following measurements were carried out using a flat plate scanner under the circumstance of normal temperature and normal humidity (20° C., 40% RH).

$V_{DDP}$: The surface potential after one second since negatively charging the sample by applying corona discharging of −6.0 KV.

dV/dE: Sensitivity of the sample to spectral light of 680 n.m. formed by using a band path filter.

$V_{RP}$: The surface potential after irradiating the sample with white light of 50 erg/cm$^2$ for 0.5 second.

The results obtained are shown in Table 5 below.

EXAMPLES 2 to 6

By following the same procedure as Example 1 except that each of the finely powdered bisbenzimidazole perylene pigments and each of the coating solvents shown in Table 5 below were used, each of electrophotographic photoreceptors was prepared and the properties thereof were measured as in Example 1.

The results obtained are shown in Table 5.

Comparative Examples 1 to 4

By following the same procedure as Example 1 except that each of the finely powdered bisbenzimidazole perylene pigments and each of the coating solvents shown in Table 5 below were used, each of electrophotographic photoreceptors was prepared and the properties thereof were measured as in Example 1.

The results obtained are shown in Table 5.

TABLE 5

| | Charge Generating Material | Coating Solvent | Initial Characteristic of Electrophotoreceptor | | |
|---|---|---|---|---|---|
| | | | $V_{DDP}$ (V) | dV/dE (Vcm$^2$/erg) | $V_{RP}$ (V) |
| Example 1 (a) | Syn. Ex. 2 | Butanol | −800 | 120 | −80 |
| Example 1 (b) | Syn. Ex. 2 | Butanol | −795 | 115 | −85 |
| Example 2 (a) | Syn. Ex. 2 | n-Butyl Acetate | −800 | 125 | −75 |
| Example 2 (b) | Syn. Ex. 2 | n-Butyl Acetate | −795 | 110 | −85 |
| Example 3 (a) | Syn. Ex. 3 | Butanol | −810 | 150 | −35 |
| Example 3 (b) | Syn. Ex. 3 | Butanol | −805 | 145 | −40 |
| Example 4 (a) | Syn. Ex. 3 | n-Butyl Acetate | −815 | 155 | −30 |
| Example 4 (b) | Syn. Ex. 3 | n-Butyl Acetate | −805 | 145 | −40 |
| Example 5 (a) | Syn. Ex. 4 | Butanol | −810 | 170 | −20 |
| Example 5 (b) | Syn. Ex. 4 | Butanol | −800 | 165 | −25 |
| Example 6 (a) | Syn. Ex. 4 | n-Butyl Acetate | −810 | 175 | −20 |
| Example 6 (b) | Syn. Ex. 4 | n-Butyl Acetate | −800 | 165 | −25 |
| Comparative Example 1 (a) | Syn. Ex. 2 | Cyclohexanone | −800 | 115 | −85 |
| Comparative Example 1 (b) | Syn. Ex. 2 | Cyclohexanone | −810 | 80 | −125 |
| Comparative Example 2 (a) | Syn. Ex. 2 | THF | −800 | 110 | −85 |
| Comparative Example 2 (b) | Syn. Ex. 2 | THF | −805 | 85 | −120 |
| Comparative Example 3 (a) | Syn. Ex. 1 | Cyclohexanone | −820 | 20 | −600 |
| Comparative Example 3 (b) | Syn. Ex. 1 | Cyclohexanone | −820 | 15 | −600 |
| Comparative Example 4 (a) | Test 1 | Butanol | −800 | 80 | −120 |
| Comparative Example 4 (b) | Test 1 | Butanol | −800 | 75 | −125 |

Syn. Ex.: Synthesis Example (a): Immediately after dispersion.

(b): After one weak since the dispersion.

As is also clear from the results shown in the above table, it can be seen that since in the present invention, the charge generating layer is formed using a pigment-dispersed coating liquid having a long pot life and stabilized dispersibility and electric characteristics, the electrophotographic photoreceptor having a high sensitivity can be stably prepared.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive substrate having formed thereon at least a charge generating layer and a charge transporting layer, wherein said charge generating layer is formed using a dispersed coating liquid prepared by mechanically grinding a perylene pigment and dispersing the ground perylene pigment in water, an alcohol series solvent, or an acetic acid ester solvent, said ground perylene pigment having strong diffraction peaks at about 6.2°, 12.3° and 26.6° to 26.9° of the Bragg angle ($2\theta \pm 0.2°$).

2. The electrophotographic photoreceptor of claim 1, wherein said charge transporting layer contains a benzidine series compound represented by the following general formula

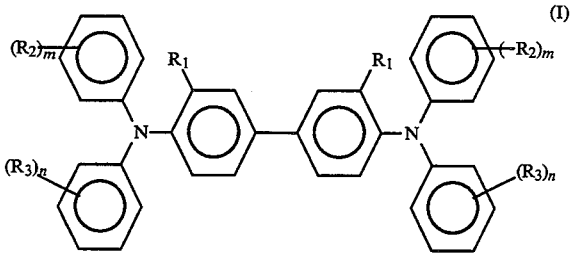

wherein $R_1$ represents a hydrogen atom, an alkyl group, an alkoxy group, or a halogen atom; $R_2$ and $R_3$ each represents a hydrogen atom, an alkyl group, an alkoxy group, a halogen atom or a substituted amino group; and m and n each represents 0, 1, or 2.

3. The electrophotographic photoreceptor of claim 1, wherein said charge generating layer is composed of a binder resin having dispersed therein the mechanical ground perylene pigment having an average particle size of from $0.03 \times 0.05$ μm to $0.05 \times 0.1$ μm.

4. The electrophotographic photoreceptor of claim 1, wherein said ground perylene pigment is dispersed in water.

5. The electrophotographic photoreceptor of claim 1, wherein said ground perylene pigment is dispersed in n-butyl acetate.

6. The electrophotographic photoreceptor of claim 1, wherein said perylene pigment is N,N'-diphenylperylene-3,4,9,10-tetracarboxylic acid diimide, cis-bisbenzimidazo(2,1-a-1',1'-b)anthra(2,1,9-def:6,5,10-d'e'f')diisoquinoline-6,11-dione or trans-bisbenzimidazo(2,1-a-1,1'-b)anthra(2,1,9-def:6,5,10-d'e'f')diisoquinoline-10,21-dione.

7. The electrophotographic photoreceptor of claim 1, wherein said perylene pigment is benzimidazole perylene pigment.

8. A process of producing an electrophotographic photoreceptor composed of an electrically conductive substrate having formed thereon at least a charge generating layer and a charge transporting layer using a coating liquid for the charge generating layer and a coating liquid for the charge transporting layer, which comprises forming said charge generating layer using a dispersed coating liquid obtained by mechanically grinding a perylene pigment and dispersing the ground pigment in water, or n-butyl acetate.

9. The process of producing an electrophotographic photoreceptor according to claim 8, comprising dispersing in water N,N'-diphenylperylene-3,4,9,10-tetracarboxylic acid diimide, cis-bisbenzimidazo(2,1-a-1',1'-b)anthra(2,1,9-def:6,5,10-d'e'f')diisoquinoline-6,11-dione or transbisbenzimidazo(2,1-a-1,1'-b)anthra(2,1,9-def:6,5,10-d'e'f')diisoquinoline-10,21-dione.

10. The process of producing an electrophotographic photoreceptor according to claim 8, comprising dispersing benzimidazole perylene pigment in water.

11. A process of producing an electrophotographic photoreceptor comprising forming a charge generating layer by applying a coating liquid comprising perylene pigment having strong diffraction peaks at about 6.2°, 12.3° and 26.6° to 26.9° of the Bragg angle ($2\theta \pm 0.2°$) dispersed in water, an alcohol series solvent, or an acetic acid series solvent.

12. The process of producing an electrophotographic photoreceptor according to claim 11, wherein said perylene pigment is dispersed in n-butyl acetate.

13. The process of producing an electrophotographic photoreceptor according to claim 11, wherein said perylene pigment is dispersed in water.

14. The process of producing an electrophotographic photoreceptor according to claim 11, wherein said perylene pigment is selected from the group consisting of N,N'-diphenylperylene-3,4,9,10-tetracarboxylic acid diimide, cis-bisbenzimidazo(2,1-a-1',1'-b)anthra(2,1,9-def:6,5,10-d'e'f')diisoquinoline-6,11-dione and trans-bisbenzimidazo(2,1-a-1,1'-b)anthra(2,1,9-def:6,5,10-d'e'f')diisoquinoline-10,21-dione.

15. The process of producing an electrophotographic photoreceptor according to claim 11, wherein said coating liquid comprises benzimidazole perylene pigment.

* * * * *